US009533813B1

(12) United States Patent
Conrad

(10) Patent No.: US 9,533,813 B1
(45) Date of Patent: Jan. 3, 2017

(54) RE-CLOSABLE, TAMPER-RESISTANT, STAND-UP PACKAGE

(71) Applicant: Sealstrip Corporation, Gllbertsville, PA (US)

(72) Inventor: Rachel P Conrad, Gilbertsville, PA (US)

(73) Assignee: Sealstrip Corporation, Gilbertsville, PA (US)

( * ) Notice: Subject to any disclaimer, the term of this patent is extended or adjusted under 35 U.S.C. 154(b) by 0 days.

(21) Appl. No.: 14/866,982

(22) Filed: Sep. 27, 2015

(51) Int. Cl.
*B65D 75/00* (2006.01)
*B65D 75/58* (2006.01)

(52) U.S. Cl.
CPC ..... *B65D 75/5833* (2013.01); *B65D 75/008* (2013.01); *B65D 75/5855* (2013.01); *B65D 2575/586* (2013.01)

(58) Field of Classification Search
CPC ..... B29C 66/71; B65D 75/5838; B65D 75/58; B65D 75/5894; B65D 75/5827; B65D 75/5833; B65D 75/5855; B65D 75/66; B65D 75/008; B65D 2575/586; B31B 19/90; G09F 3/10; Y10T 428/15
USPC ..... 383/42, 66, 200–211, 78, 81
See application file for complete search history.

(56) References Cited

U.S. PATENT DOCUMENTS 2,480,500 A * 8/1949 Moore ..... B65D 33/24 383/211
2,949,370 A * 8/1960 Hughes ..... B65D 33/16 229/87.05
3,098,601 A * 7/1963 Anderson ..... B65D 75/66 383/205
3,171,539 A * 3/1965 Holbrook ..... B29C 59/10 116/DIG. 14
3,613,874 A * 10/1971 Miller ..... B65D 77/12 206/459.5
3,626,143 A * 12/1971 Fry ..... B29C 59/007 219/121.66
3,981,230 A * 9/1976 Lee ..... B26D 1/00 156/380.9
4,092,518 A * 5/1978 Merard ..... B44B 7/00 219/121.61
4,216,254 A * 8/1980 Lundell ..... B29C 59/103 156/244.17
4,335,817 A * 6/1982 Bahr ..... B65D 33/25 206/260
4,490,203 A * 12/1984 Bose ..... B29C 65/7473 156/251

(Continued)

*Primary Examiner* — Peter Helvey
(74) *Attorney, Agent, or Firm* — Ryder, Lu, Mazzeo & Konieczny LLC; Joseph M. Konieczny, Sr.; Gregory J. Gore

(57) ABSTRACT

A re-closable, stand-up package with a tamper-evident opening system. Production of the package originates from only two feed rolls. One roll is a flexible film web and the other is an adhesive tape. A reclosing layer is constructed from a strip of web material taken from a side of the feed roll and a length of the tape. The strip portion of the closure layer is perforated along tear lines which define a package opening. The tape and the strip are then adhesively joined so that they partially overlap vertically. The closure layer is then applied to the web over a slit in the front panel forming a re-closable primary opening. A gusset fold at the bottom of the package permits the package to be free-standing vertically upright. Contents of the package can be dispensed only after rupture of the closure layer strip.

20 Claims, 3 Drawing Sheets

(56) References Cited

U.S. PATENT DOCUMENTS 4,586,312 A * 5/1986 Limousin ..... B65B 61/02 493/363
4,709,399 A * 11/1987 Sanders ..... B65D 33/1691 206/813
4,762,514 A * 8/1988 Yoshida ..... B29C 59/007 219/121.67
4,840,270 A * 6/1989 Caputo ..... B29C 59/10 206/205
4,851,061 A * 7/1989 Sorkoram ..... B23K 26/147 156/63
4,854,999 A * 8/1989 Schirmer ..... B29C 59/10 156/272.6
4,889,234 A * 12/1989 Sorensen ..... B65D 5/708 206/459.5
4,902,141 A * 2/1990 Linnewiel ..... B65D 33/1691 383/61.1
4,902,142 A * 2/1990 Lammert ..... B65D 33/20 383/205
4,931,134 A * 6/1990 Hatkevitz ..... H05K 3/0035 156/150
5,007,744 A * 4/1991 Scarberry ..... B31B 23/00 383/37
5,061,535 A * 10/1991 Kreckel ..... A61F 13/58 296/93
5,096,113 A * 3/1992 Focke ..... B65B 61/18 229/160.2
5,167,455 A * 12/1992 Forman ..... B65D 33/34 383/211
5,172,854 A * 12/1992 Epstein ..... B29C 66/24244 229/123.2
5,174,658 A * 12/1992 Cook ..... B65D 33/007 150/900
5,229,180 A * 7/1993 Littmann ..... B65D 75/5827 219/121.68
5,307,988 A * 5/1994 Focke ..... B65D 75/08 206/494
5,318,818 A * 6/1994 Sjostrom ..... B65D 75/66 229/123.2
5,407,278 A * 4/1995 Beer ..... B65D 81/3261 206/219
5,407,611 A * 4/1995 Wilhoit ..... A22C 13/0013 204/165
5,421,933 A * 6/1995 Nedblake ..... B32B 7/06 156/249
5,430,987 A * 7/1995 Lane, Jr. ..... B05C 17/00583 493/363
5,456,928 A * 10/1995 Hustad ..... B65D 33/1691 206/459.1
5,459,978 A * 10/1995 Weiss ..... A61L 2/07 206/439
5,474,637 A * 12/1995 Soodak ..... A01N 1/02 156/272.6
5,520,760 A * 5/1996 Freedman ..... B31D 1/021 156/152
5,520,764 A * 5/1996 Toney ..... B29C 47/0021 156/244.17
5,564,259 A * 10/1996 Stolmeier ..... B65B 9/093 493/214
5,591,290 A * 1/1997 Walter ..... C09J 7/0207 156/152
5,601,368 A * 2/1997 Bodolay ..... B65D 33/2533 383/203
5,607,606 A * 3/1997 Mori ..... B23K 26/046 219/121.67
5,611,949 A * 3/1997 Snellman ..... B23K 26/0838 219/121.67
5,630,308 A * 5/1997 Guckenberger ..... B23K 26/067 53/412
5,679,199 A * 10/1997 Nedblake ..... G09F 3/10 156/254
5,713,824 A * 2/1998 Drummond ..... B65D 3/266 156/190
5,725,311 A * 3/1998 Ponsi ..... B65D 75/5838 206/494
5,779,832 A * 7/1998 Kocher ..... B32B 38/0008 156/152
5,810,599 A * 9/1998 Bishop ..... G09B 5/065 434/118
5,820,953 A * 10/1998 Beer ..... B29C 59/007 428/178
5,829,884 A * 11/1998 Yeager ..... B65D 33/01 383/103
5,874,155 A * 2/1999 Gehrke ..... B29C 43/222 383/200
5,878,971 A * 3/1999 Minnema ..... C09J 7/026 242/160.4
5,914,165 A * 6/1999 Freedman ..... B32B 7/06 283/81
5,938,013 A * 8/1999 Palumbo ..... B65D 75/008 206/210
5,945,145 A * 8/1999 Narsutis ..... B65D 75/5838 383/203
5,982,284 A * 11/1999 Baldwin ..... G06K 19/0672 29/829
5,983,594 A * 11/1999 Forman ..... B31B 19/74 383/210
6,026,953 A * 2/2000 Nakamura ..... B65D 75/5838 206/233
6,062,470 A * 5/2000 Robichaud ..... B65D 5/065 229/216
6,103,050 A * 8/2000 Krueger ..... B23K 26/0846 156/251
6,113,271 A * 9/2000 Scott ..... B65D 75/5838 206/494
6,126,317 A * 10/2000 Anderson ..... B65D 75/5827 229/87.05
6,244,746 B1 * 6/2001 Tokita ..... B31B 39/00 206/484.2
6,254,519 B1 * 7/2001 Toshima ..... B65D 75/5894 383/204
6,259,058 B1 * 7/2001 Hoekstra ..... B23K 26/0057 219/121.67
6,309,745 B1 * 10/2001 Willms ..... A61F 13/58 428/352
6,328,203 B1 * 12/2001 Tedford, Jr. ..... B65D 5/70 220/270
6,350,340 B1 * 2/2002 Johnson ..... B31B 19/90 156/218
6,364,990 B1 * 4/2002 Grosskopf ..... B65D 23/003 156/252
6,457,863 B1 * 10/2002 Vassallo ..... B65D 33/007 150/129
6,461,044 B1 * 10/2002 Anderson ..... B65D 33/20 383/204
6,488,228 B2 * 12/2002 Davies ..... B65H 19/102 156/504
6,511,725 B1 * 1/2003 Rawlings ..... G09F 3/10 283/81
6,517,243 B2 * 2/2003 Huffer ..... B65D 33/20 383/116
6,592,693 B1 * 7/2003 Nedblake ..... B23K 26/0846 156/247
6,596,361 B2 * 7/2003 Klein ..... B32B 7/06 283/72
6,624,413 B1 * 9/2003 Klein ..... H01T 19/00 250/324
D482,614 S * 11/2003 Countee, Jr. ..... D7/705
6,660,963 B2 * 12/2003 Hoekstra ..... B23K 26/0736 219/121.67
6,695,501 B2 * 2/2004 Nedblake, Jr. ..... B41J 11/0015 101/288
6,719,678 B1 * 4/2004 Stern ..... B65D 33/2508 493/212
6,723,952 B2 * 4/2004 Choo ..... B23K 26/046 219/121.67
6,749,877 B2 * 6/2004 Hodson ..... B65D 75/66 426/123

(56) References Cited

U.S. PATENT DOCUMENTS 6,769,227 B2 * 8/2004 Mumpower ..... B29C 47/0021 428/36.6
6,863,646 B2 * 3/2005 Kinigakis ..... B31B 19/90 493/213
6,865,860 B2 * 3/2005 Arakawa ..... B65B 9/2028 53/133.8
6,918,532 B2 * 7/2005 Sierra-Gomez .... B65D 75/5838 206/459.1
6,924,829 B2 * 8/2005 Kusano ..... B26D 1/245 347/157
6,974,256 B2 * 12/2005 Kinigakis ..... B65D 33/2591 383/204
7,056,593 B2 * 6/2006 Kennedy ..... B32B 27/08 428/516
7,122,235 B2 * 10/2006 Bourdelais ..... B23K 26/0846 428/192
7,250,210 B2 * 7/2007 Mazurek ..... B29C 43/222 428/156
7,254,873 B2 * 8/2007 Stolmeier ..... B32B 7/08 24/400
7,304,265 B2 * 12/2007 Otsu ..... B23K 26/0604 219/121.62
7,306,370 B2 * 12/2007 Howell ..... B31B 19/90 383/204
7,331,159 B2 * 2/2008 Osgood ..... B65B 11/12 53/412
7,371,008 B2 * 5/2008 Bonenfant ..... B65D 75/5838 229/81
7,410,298 B2 * 8/2008 Pawloski ..... B65D 33/2541 24/585.12
7,481,580 B2 * 1/2009 Schreiter ..... B65D 33/2591 383/203
7,592,057 B2 * 9/2009 Dronzek, Jr. ..... B32B 7/06 427/207.1
7,651,290 B2 * 1/2010 Bauer ..... A45D 34/04 401/132
7,673,909 B2 * 3/2010 Rousselet ..... G09F 3/0288 283/101
7,717,620 B2 * 5/2010 Hebert ..... B29C 59/007 383/116
7,789,236 B2 * 9/2010 Burgess ..... B65D 75/5838 206/233
8,814,430 B2 * 8/2014 Veternik ..... B65D 75/5844 229/87.05
9,090,383 B2 * 7/2015 Forman ..... B65D 75/40
2001/0037627 A1 * 11/2001 Hausslein ..... B31B 19/60 53/455
2002/0068668 A1 * 6/2002 Chow ..... B31B 1/25 493/62
2005/0053315 A1 * 3/2005 Aasen ..... B65D 31/02 383/119
2006/0219072 A1 * 10/2006 Tynkkynen ..... B26D 1/045 83/177
2006/0251341 A1 * 11/2006 Sampaio Camacho ..... B65D 33/20 383/62
2007/0020423 A1 * 1/2007 Chamandy ..... G09F 3/10 428/40.1
2007/0270310 A1 * 11/2007 Blank ..... B41M 5/30 503/226
2008/0063321 A1 * 3/2008 Hodson ..... B31B 19/90 383/64
2009/0152139 A1 * 6/2009 Roesink ..... A24F 23/02 206/260
2010/0111453 A1 * 5/2010 Dierl ..... B65B 9/213 383/204
2011/0204056 A1 * 8/2011 Veternik ..... B65D 75/5844 220/270
2013/0121623 A1 * 5/2013 Lyzenga ..... B65B 9/207 383/203
2013/0121624 A1 * 5/2013 Lyzenga ..... B65B 9/067 383/203
2013/0142455 A1 * 6/2013 Forman ..... B65D 75/40 383/42
2016/0031608 A1 * 2/2016 Olechowski ..... B65D 33/1691 383/210.1

* cited by examiner

FIG. 4
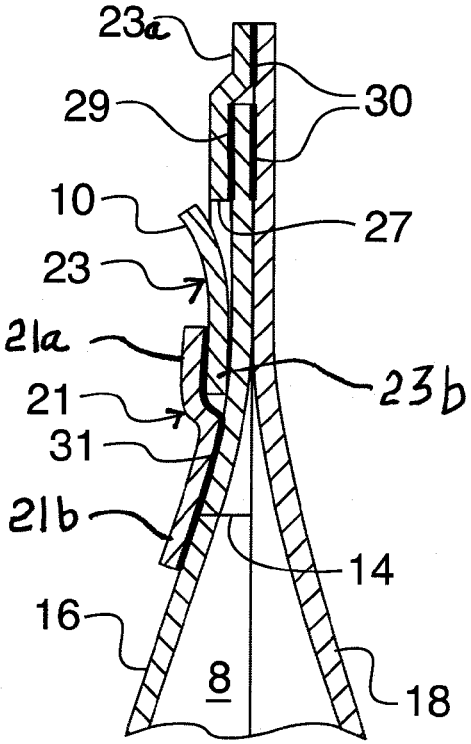
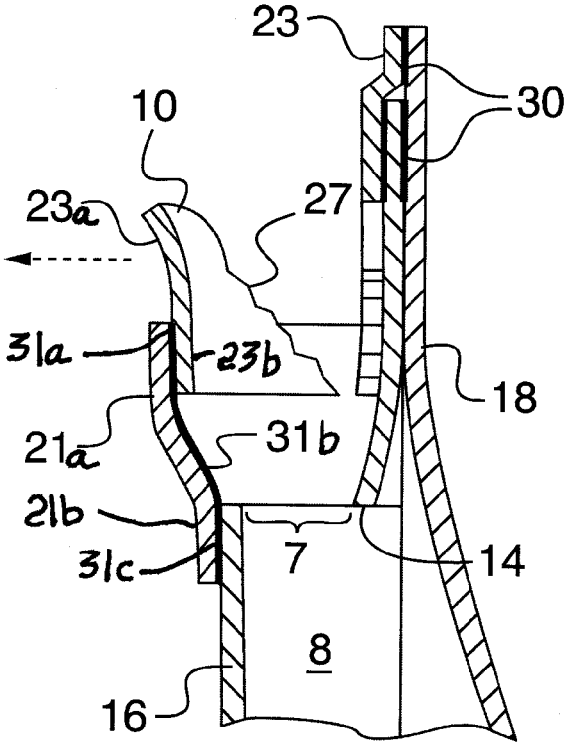
FIG. 5

RE-CLOSABLE, TAMPER-RESISTANT, STAND-UP PACKAGE

FIELD OF THE INVENTION

The present invention relates to flexible packaging. More specifically, it relates to stand-up type pouches that have tamper-evident, re-closable openings.

BACKGROUND OF THE INVENTION

Currently, most stand-up, re-closable packages are made in such a way that the consumer must tear away and discard the tear strip at the top of the package to access the product within the package. The tear strip is typically located above the zipper or slider at the top of the package. Because of the way these packages are made, the bag material often tears unreliably and not along a straight line. Sometimes the bag material only partially tears, which leaves leftover edges of film that interfere with the reclosing function of the zipper or slider. Many consumers also do not enjoy holding and then disposing the torn-away part of the package.

Furthermore, the construction of these stand-up, re-closable packages requires a heavier, thicker film material that adds to their production cost. While these stand-up packages have the advantage of being tamper evident because access can only be made after part of the bag has been permanently destroyed, the noted disadvantages are problems that the packaging industry still faces. Therefore, it would be desirable to provide a re-closable, tamper-evident, stand-up package that avoids the aforementioned problems in the prior art, is less expensive and easier to manufacture, and functions reliably.

SUMMARY OF THE INVENTION

The package of the present invention meets the need in the packaging arts for a better re-closable, stand-up package. The package of the present invention is tamper-evident but does not have the usual tear-off strip. The novel package has stand-up functionality and has an economical and reliable tamper-evident and re-closable opening system that has many consumer applications.

In one preferred embodiment of the invention, the package originates from two feed rolls. One roll is a flexible film web and the other is an adhesive tape. A reclosing layer is constructed from a strip of web material taken from a side of the film feed roll and a length of the tape. The tape and the strip are then adhesively joined so that they partially overlap laterally. A lateral slit is made in the web and the closure layer is then affixed to the web with a portion of the tape overlapping the slit. The body of the package is then formed by the simultaneous heat sealing of the package and reclosing layer along the side edges of the package body. After contents are added to the package, it is closed by heat sealing the top edges of the package body with the top of the closure layer strip.

More specifically, the package has a body formed by folding a flexible film web at a bottom to create opposing front and back panels. The panels are united along opposing lateral side edges thereof and along top edges of the panels at the top end of the body. So constructed, the body defines an interior space for holding contents dispensable through an opening provided by a lateral slit through the front panel.

A two-part composite closure layer consists of a strip of web material and an adhesively-coated tape that is partly adhered to the strip in a laterally overlapping manner. As a result of this construction, a top portion of the strip is not covered by the tape and a bottom portion of the tape is not covered by the strip. The closure layer lies laterally across the front of the front panel with the tape on the outside of the layer. The top portion of the strip not covered by the tape is united to the front and rear panels along the top of the body and along the side edges of the body by heat sealing. The closure layer strip extends from the top edge of the body downward to a point above the front panel slit. A die cut pull tab on the closure layer strip provides a dry edge for grasping and tearing open the strip. A tear line is defined by perforations that extend downwardly from either side of the pull tab. The top edge of the tape lies between the pull tab and the bottom edge of the strip. A bottom portion of the tape not covered by the strip extends downward over the package opening slit and is secured to the front panel by adhesion and at the sides by heat sealing. The heat sealing of the closure later is preferably accomplished at the same time as the formation of the package body.

The closure layer strip is preferably non-adhesive and is composed of the package flexible film taken from a side edge of the film during the package production process. The fold at the bottom of the package body is preferably a gusset fold that permits the package to stand upright on its own. That is to say that the package can be free-standing upright lengthwise on its vertical axis.

The package of the present invention has many differences from prior art stand-up packages that incorporate a zipper or a slider with a tear-off strip. Other advantages and differences will follow from the foregoing explanation and the following drawings and description of the invention. The preferred embodiment of the invention will provide one of skill in the art with a full understanding of what has been invented. It will thereby be appreciated that the stand-up package has various advantages over the prior art.

BRIEF DESCRIPTION OF THE DRAWINGS

FIG. 4 is a cross-section taken along lines 4-4 of FIG. 1; and,

FIG. 5 is a cross-section taken along lines 5-5 of FIG. 3.

DESCRIPTION OF THE PREFERRED EMBODIMENT

Figure 1:
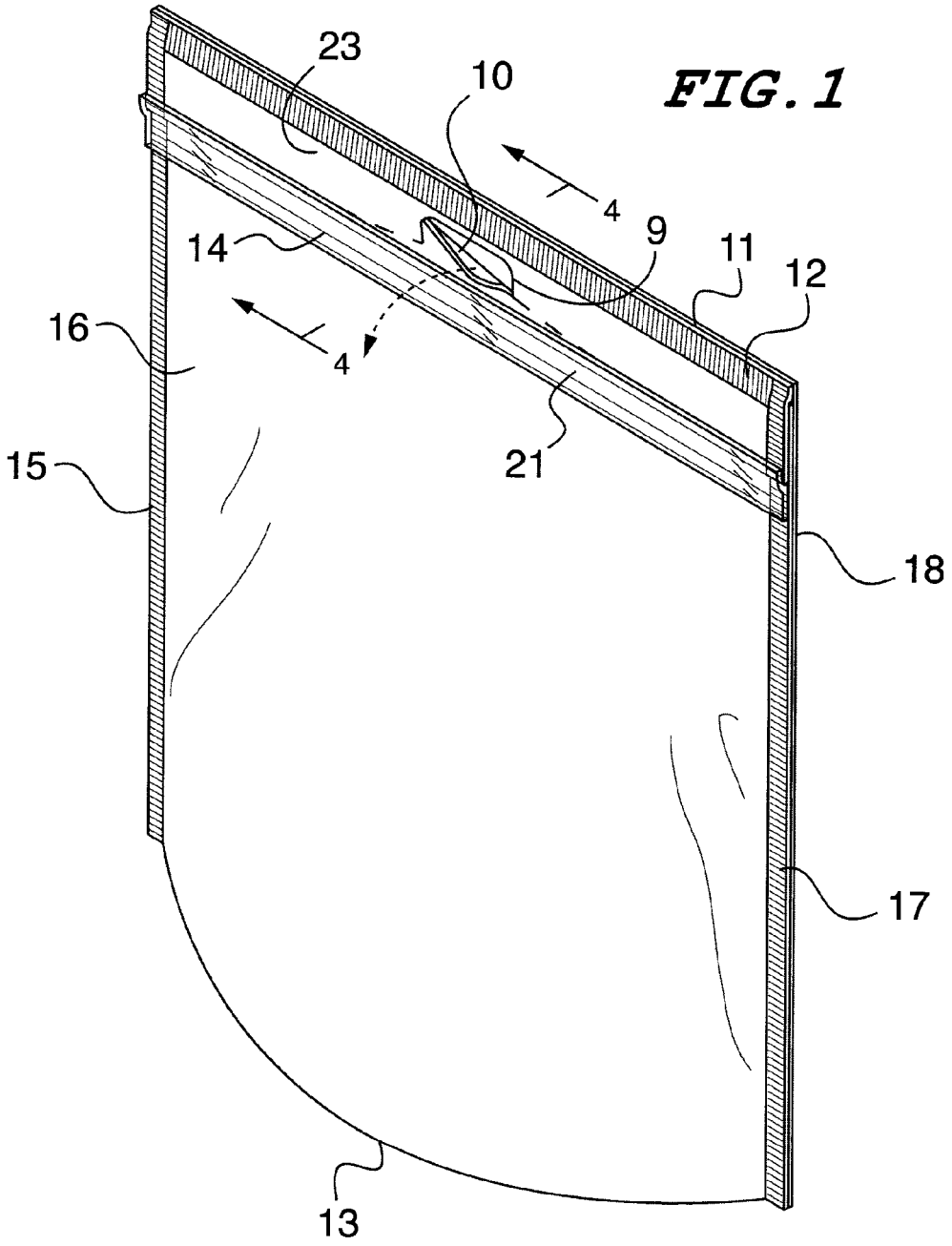
FIG. 1 is a top right front perspective of a package in accordance with an embodiment of the invention.
Figure 2:
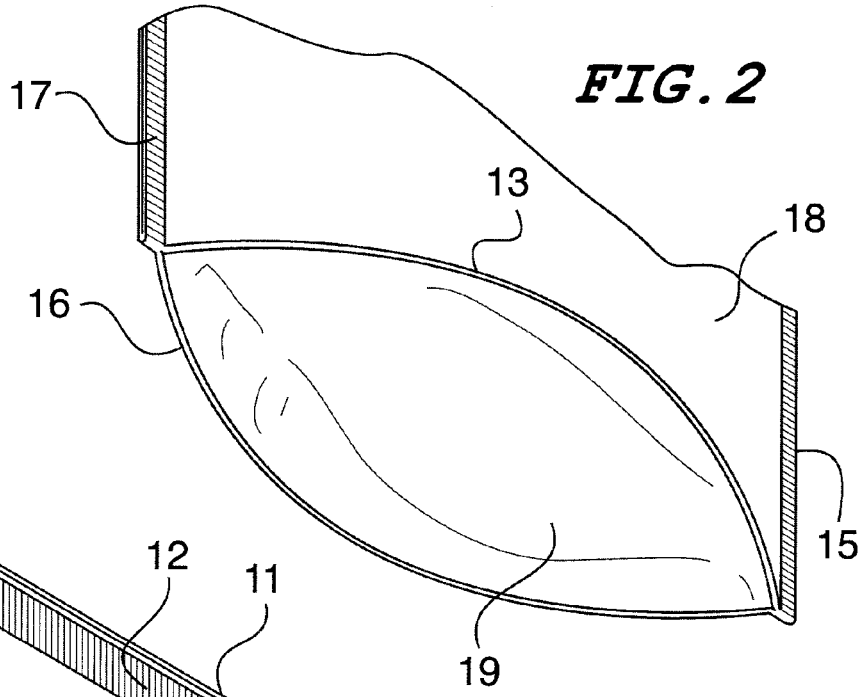
FIG. 2 is a partial bottom left perspective of the package of FIG. 1.

A re-closable, stand-up package in accordance with a preferred embodiment of the invention is shown in FIGS. 1-5. The package has a body with a top 11, a bottom 13 and vertically-extending opposed side edges 15, 17. The package has front and rear panels 16, 18 formed by folding a web of flexible film at the bottom of the package into a gusset fold 19 best seen in FIG. 2. The panels are joined by heat sealing along the side edges 15, 17 and then along the top edge 12, which creates a package body with an enclosed interior space 8 for holding the contents of the package. The front panel 16 has a lateral slit 14 that provides an opening through which the package contents can be dispensed.

Referring to FIGS. 1 and 4, the lateral slit 14 is closed/sealed with a two-part closure layer comprising a non-adhesive strip of web film 23 a transparent tape 21 having an adhesive coating 31. The tape 21 and the strip 23 overlap along a laterally-extending connection interface 31*a* wherein the tape 21 is arranged on the outside of the strip 23 at the connection interface 31*a*. The tape 21 and strip 23 are of equal length and extend the full width of the package. With reference to the orientation shown in the drawings, the connection interface 31*a* is formed between the upper portion of the tape and the lower portion of the strip 23. The connection interface 31*a* is formed by an adhesive, preferably a permanent adhesive, on the top portion 21*a* of the tape 21, and heat seals 20 at the edges.

Along its length (width of the package), the top portion 23*a* of the strip 23 is adhered to the front panel 16 by a heat seal 29 and to the back panel 18 by a heat seal 20. Neither heat seal 29, 30 extends down to the tab 10 so that 10 the tab can be freely peeled away from the strip 23 as seen in FIG. 1. No other portion of the strip 23 is adhered to the front 16 or back 18 panel, including the portion of the strip at the connection interface 31*a*. Along the length of the tape (width of the package) and below the connection interface 31*a*, the tape 21 is 31*b* and a permanent adhesion interface 31*c*. The re-sealable adhesion interface 31*b* extends the length of the tape 21 (width of the package) and overlaps above and below the slit 14. The re-sealable adhesion interface 31*b* is provided so that the package can be re-sealed after emptying only a portion of its contents. The permanent adhesion interface 31*c* is provided so that the package contents cannot be tampered with without rupturing the closure layer.

The closure layer includes a pull tab 10 for opening the package. The pull tab 10 is formed by die cutting perforations 9 in the strip 23, and defines a top opening through which the package contents are dispensed. In FIGS. 1 and 4, tab 10 is shown partially pulled away from the strip 23; however, in this configuration, the re-sealable adhesive interface 31*b* of the tape 21 still covers the entire slit 14 and holds it closed.

Figure 3:
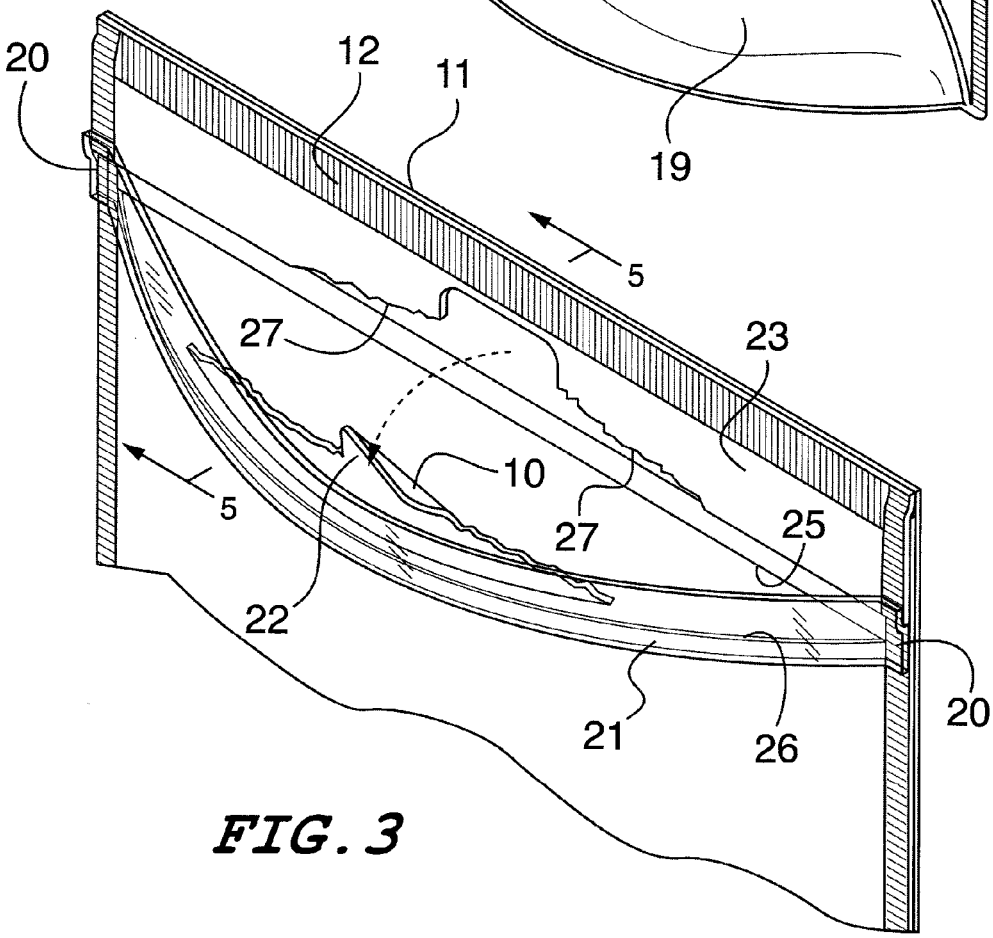
FIG. 3 is a top right front perspective of the package of FIG. 1 shown in an opened configuration.

The package is opened by first pulling the tab 10 away from the package so that the lower portion of the front panel separates from the upper portion of the front panel along the slit 14 as seen in FIG. 3. In this Figure, the closure layer is shown torn open along opposed tear lines 27. In this configuration, the re-sealable adhesive interface 31*b* of the tape 21 has been pulled away and no longer straddles the slit 14, which allows the front panel portions to separate along the slit 14. However, the tape 21 remains adhered to the front panel 16 at the permanent adhesive interface 31*c*. To empty the package, its contents must first pass through the slit 14 opening and then must pass behind the tape 21 and out through the torn opening at the top.

In a preferred embodiment, the slit 14 is a cut through the front panel 16 without the removal of material. When closed, the edges 25 and 26 of the slit 14 are in arranged in close abutment. While a slit is the preferred form of creating the primary package opening, other larger openings of different shapes and sizes other than a slit are possible. Some advantages of employing a slit are a greater surface area for the closure tape and a barrier preventing the tape 21 from adhering to the rear panel or package contents through the opening.

FIGS. 1 and 4 show the closure layer when the tab 10 is first torn open. The tape 21 is coated with a re-sealable adhesive 31 across the top in the middle area below the tear line. In all other areas especially all areas below the slit, the tape adhesive is a permanent adhesive to prevent tampering. The tape is preferably transparent so that package graphics beneath the tape are not hidden. After contents are first placed into the package, the front and rear panels 16 and 18 together with strip 23 are all heat sealed simultaneously across the top of the package by melted material 30 between the panels and melted material 29 between the front panel and the strip 23. The joinder of the front and rear panels at the sides and across the top creates an interior space 8 for holding contents of the package Referring now to FIG. 5, the package is depicted fully opened as also shown in FIG. 3. By pulling the tab 10, the closure strip 23 has been opened along opposed tear lines 27. The tape 21 spans the gap between the top edge of the lower portion of the front panel 16 and the bottom portion of the strip 23. With the slit 14 now pulled open, an opening 7 is formed which permits the contents of the package occupying the interior space 8 to be dispensed behind the tape 21 and then through the second opening at the top defined by the tear line 27. The other numbered elements of FIG. 5 correspond to those mentioned in regard to FIG. 4 without further description needed.

With continued reference to FIGS. 4 and 5, to open the package the user grasps the closure layer strip 23 in the area of the pull tab 10 and tears it from the top portion of the closure strip 23 along the perforated tear line 27 as seen in FIG. 4. The pull tab 10 provides a dry edge for grasping and easily tears open the closure layer because it is not adhered to the package body in the area of the tear lines but only at the side edges and along the top of the package body by heat seal attachment 29. It remains attached to the package body unlike the tear-off strips of the prior art. Further pulling on the tab separates the tape portion of the closure layer from above the slit opening so that contents of the package can then be removed through the slit by separating the slit sides to form an opening 7 as seen in FIG. 5. As the contents are dispensed, they pass behind the tape 21 and through the closure layer opening defined by the tear line 27 in the closure layer strip 23. The package can be resealed simply by pressing the tape back against the front panel over the slit. After a first opening, the torn closure layer provides permanent evidence that the package has been opened or tampered with.

The embodiment depicted in FIGS. 1-5 can be manufactured by production machinery which need only be fed by a single roll of flexible film web material and a roll of adhesive tape. In production, the web travels along a path during which a strip of material is cut from a side edge of the film web. Thereafter, perforations are die-cut into the strip along a desired tear line. This perforated strip is then adhesively united with the adhesive tape forming the above described two-part closure layer. The web is then laterally slit and a cut segment of the closure layer is applied across the width of the web with a portion of the tape not covering the strip applied over the slit. The web is then folded with a gusset-forming fold device creating the opposing front and rear panels. The closure layer and side edges of the panels are then all united by heat sealing on the sides. After contents are added into the package, the top portion of the closure layer strip and the panels are heat sealed across the top, closing the package. One advantage of this package structure and manufacturing process is that there is no waste or remaining scrap left over to dispose.

From the foregoing it will be apparent to one of skill in the packaging arts that a stand-up pouch has been devised which is very economical to produce. It provides an easy-open, re-closable, tamper-evident construction in a stand-up package that does not require a tear-off component. Because the contents of the package can only be dispensed through the closure layer, the tearing open of the closure is a permanent indication of a first opening of the package or tampering. Compared to competing packages which employ a zipper or a slider opening the present invention can be formed from much thinner material saving cost. These advantages and others represent a significant advance in the packaging arts.

While only one embodiment of the invention is depicted in the drawings described above, there can be variations in dimension and proportionality. Furthermore, the means of production can be any suitable means available to the art at that time. Many modifications to the preferred embodiment may be possible without departing from the scope and spirit of the invention which shall be defined only by the following claims and their legal equivalents.

The invention claimed is:

1. A package, comprising:

a package body having a length and a width with a front panel and a rear panel formed by folding a flexible film web at a bottom end of the body, said panels joined at opposite side edges of the body and along a top edge of the body to create an interior space for holding dispensable contents of the package;

a lateral slit in the front panel adapted to provide an opening on the package through which the contents from said interior space can be dispensed;

a laterally extending closure layer composed of two partially overlapping parts, a strip of web film and an adhesively coated tape adhered the strip such that a top portion of the strip is not covered by the tape and a bottom portion of the tape is not covered by the strip; and wherein the top portion of the strip not adhered to the tape is affixed to the front panel along the top edge of the body and the bottom portion of the tape not adhered to the strip is adhered to the front panel and covers the slit such that the package contents can be dispensed by opening the slit and thereafter the package can be reclosed by pressing the tape over the slit.

2. The package of claim 1 further including perforations in the top portion of the closure layer strip capable of manual tearing whereby a second package opening is formed through which contents dispensed through the slit opening must pass.

3. The package of claim 2 wherein the perforations define a vertically extending pull tab at a topmost region of the perforations.

4. The package of claim 1 wherein a bottom edge of the closure layer strip lies above the slit.

5. The package of claim 2 wherein a top edge of the tape lies below the perforations.

6. The package of claim 1 wherein the tape and the strip of the closure layer both extend the entire width of the package body.

7. The package of claim 1 wherein the closure layer strip is non-adhesive.

8. The package of claim 1 wherein the closure layer strip is affixed to the top edge of the package body by the simultaneous heat sealing of the front and rear panels.

9. The package of claim 6 wherein the closure layer strip is affixed to the side edges of the package body by the simultaneous heat sealing of the side edges of the package body.

10. The package of claim 6 wherein the closure layer tape is affixed to the side edges of the package body by the simultaneous heat sealing of the side edges of the package body.

11. The package of claim 3 wherein the pull tab provides a non-adhesive dry edge for grasping by the user.

12. The package of claim 1 wherein the fold at the bottom end of the body is a gusset fold.

13. The package of claim 12 wherein the gusset fold is the flexible web folded into the contents interior space.

14. The package of claim 11 wherein the pull tab is arcuate.

15. The package of claim 1 wherein the package is free-standing vertically lengthwise supported by the gusset fold at the bottom end.

16. The package of claim 1 wherein the tape is transparent.

17. The package of claim 2 wherein the perforations are die-cut through the web.

18. A package, comprising:

a package body having a length and a width with a front panel and a rear panel formed by folding a single piece of flexible film web at a gusset fold at a bottom end of the body, said panels joined at opposite side edges of the body and along a top edge of the body by heat sealing to create an interior space for holding dispensable contents of the package;

a first opening in the front panel through which the contents from said interior space can be dispensed;

a laterally extending closure layer affixed across the top of the package body, said layer composed of two partially overlapping parts, a strip of the film web and an adhesively coated tape adhered to the strip, both the strip and the tape extending laterally the entire width of the package body and are affixed thereto by the simultaneous heat sealing of the side edges of the package body;

a top portion of the strip not adhered to the tape affixed to the front panel along the top edge of the body by heat sealing, said top portion having manually tearable perforations defining a second opening through which contents of the package first dispensed through the slit opening must pass, said strip located entirely above the first opening and said second opening having a vertically extending arcuate non-adhesive pull tab at a top most end thereof; and a bottom portion of the tape not adhered to the strip adhered to the front panel and covering the entire first opening such that the package contents can be dispensed through the first opening and thereafter the package can be reclosed by the tape, said package being free-standing vertically upright supported at the bottom end of the package body by the gusset fold.

19. The package of claim 18 wherein the opening in the front panel is a slit adapted to from an opening when the edges of the slit are separated, and when said opening is closed said edges are in close abutment.

20. The package of claim 19 wherein the adhesive on the tape that lies below the slit is a permanent adhesive and at least a portion of the adhesive on the tape that lies above the slit is a non-permanent re-sealable adhesive.

* * * * *